US007887294B1

(12) United States Patent
Liang

(10) Patent No.: US 7,887,294 B1
(45) Date of Patent: Feb. 15, 2011

(54) TURBINE AIRFOIL WITH CONTINUOUS CURVED DIFFUSION FILM HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 762 days.

(21) Appl. No.: 11/580,413

(22) Filed: Oct. 13, 2006

(51) Int. Cl.
*F01D 5/18* (2006.01)

(52) U.S. Cl. ..... 416/97 R

(58) Field of Classification Search ..... 415/115–116; 416/95, 96 R, 96 A, 97 R
See application file for complete search history.

(56) References Cited

U.S. PATENT DOCUMENTS

| | | | |
|---|---|---|---|
| 3,527,543 | A | 9/1970 | Howald |
| 4,653,983 | A | 3/1987 | Vehr |
| 4,664,597 | A | 5/1987 | Auxier et al. |
| 4,684,323 | A | 8/1987 | Field |
| 4,705,455 | A | 11/1987 | Sahm et al. |
| 4,738,588 | A | 4/1988 | Field |
| 5,382,133 | A | 1/1995 | Moore et al. |
| 6,183,199 | B1 | 2/2001 | Beeck et al. |
| 6,243,948 | B1 | 6/2001 | Lee et al. |
| 6,287,075 | B1 | 9/2001 | Kercher |
| 6,307,175 | B1 | 10/2001 | Blochlinger et al. |
| 6,869,268 | B2 | 3/2005 | Liang |
| 6,918,742 | B2 | 7/2005 | Liang |
| 7,041,933 | B2 | 5/2006 | Forrester et al. |
| 2002/0197160 | A1 * | 12/2002 | Liang ..... 416/92 |

* cited by examiner

*Primary Examiner*—Christopher Verdier
(74) *Attorney, Agent, or Firm*—John Ryznic

(57) ABSTRACT

A turbine airfoil with a plurality of film cooling holes having a diffuser having both stream-wise and spanwise expansion of the cooling air flow. The diffuser is formed from a series of ellipses with a gradual increase in the cross sectional areas in the flow direction. The diffuser has a stream-wise surface of continuous curvature of about 7 degrees, and both the spanwise outward surface and the spanwise inward surface has a continuous curvature of about 7 degrees. The upstream side surface of the diffuser is formed substantially along a straight line. The ellipse shaped diffuser has spanwise and stream-wise curved surfaces such that at the hole opening onto the airfoil wall, the hole has an elliptical cross sectional shape with the major axis in the spanwise direction of the airfoil.

13 Claims, 2 Drawing Sheets

TURBINE AIRFOIL WITH CONTINUOUS CURVED DIFFUSION FILM HOLES

BACKGROUND OF THE INVENTION

1. Field of the Invention

The present invention relates generally to fluid reaction surfaces, and more specifically to film cooling holes in a turbine airfoil.

2. Description of the Related Art including information disclosed under 37 CFR 1.97 and 1.98

A gas turbine engine burns a fuel to produce a hot gas flow for the production of mechanical power. Compressed air from a compressor is mixed with a fuel in the combustor to produce the hot gas flow. The hot gas flow is then passed through a turbine having multiple stages of stator vanes and rotor blades to extract mechanical power from the flow. The engine efficiency can be increased by increasing the hot gas flow into the turbine. However, the turbine parts—especially the first stage stator vanes and rotor blades—are exposed to the hottest temperature and therefore the limiting properties of these parts determine the highest temperature entering the turbine.

One method of increasing the temperature into the turbine is to provide complex cooling circuits within the airfoils (stator vanes, rotor blades). Complex multi-pass serpentine cooling flow circuits have been proposed to provide high levels of cooling using low amounts of cooling air. Since the cooling air used within the airfoils is generally bleed off air from the compressor, maximizing the cooling effect of the air while minimizing the amount of air used will also increase the engine efficiency. Besides the internal cooling circuit within an airfoil film cooling holes are also used to provide a film of cool air on the surface of the hottest parts of the airfoil. Axial and radial cooling holes have been used to provide film cooling to the airfoil.

To achieve a high cooling effectiveness, cooling air discharged through film cooling holes must be deflected as rapidly as possible and flow in a protective manner along the profile surface of the airfoil. To protect zones lying between the bores, rapid lateral spreading of the cooling air is also necessary. This is achieved by using a diffuser with the cooling holes which due to the lateral widening permits a wider area of the airfoil surface to be covered. The diffuser also lowers the velocity of the cooling air from the hole so that the cooling air does not blow out from the film layer and into the hot gas flow. Geometric diffuser forms in which the bore hole is widened not only laterally but also on the downstream side of the hole are used to further improve the mixing behavior. The blow-out rates in these diffuser holes are small so that there is little risk of the cooling air passing through the flow boundary layer.

Ideally, it is desired to bathe 100% of the airfoil surface with a film of cooling air. However, the cooling air leaving the cooling hole exit generally forms a cooling film stripe no wider than or hardly wider than the dimension of the cooling hole exit perpendicular to the hot gas flow. Limitations of the number, size and spacing of the cooling passages results in gaps in the protective film and/or areas of low film cooling effectiveness which produce localized hot spots on the airfoil. Airfoil hot spots are one factor which limits the operating temperature of the engine.

A standard film cooling hole 14 is shown in FIG. 1 which passes straight through the airfoil wall 12 at a constant diameter and exits at an angle to the surface 13. FIG. 2*a* shows a top view of this film cooling hole 15, and FIG. 2*b* shows a side view. Because the cooling hole 14 is not perpendicular to the airfoil surface 13, the opening 15 of the hole has a longer major axis than the minor axis as shown in FIG. 2*a*. Some of the cooling air is consequently ejected directly into the mainstream causing turbulence, coolant dilution, and loss of downstream film effectiveness. In addition, the hole breakout in the stream-wise elliptical shape will induce stress problems in the blade application. The stress field is shown in FIG. 1 as reference numeral 17 in this film cooling hole design. The film of cooling air is represented by 16 as it is discharged from the hole 15.

BRIEF SUMMARY OF THE INVENTION

An improvement in the film cooling effectiveness for a film cooling hole can be produced by the use of a film hole geometry of the present invention. A film cooling hole includes a three dimensional continuous curved diffusion film hole. The three dimensional nature of the film cooling hole of the present invention is described by a series of ellipses of increasing eccentricity tangent at the point corresponding to the minor axis. The film hole construction will allow for radial diffusion of the stream-wise oriented flow and combine the best aspects of both radial and stream-wise straight holes. The diffusion film hole has the expansion radial and rearward hole surfaces curved toward both the airfoil trailing edge and span-wise directions. Coolant penetration into the gas path is thus minimized, yielding good build-up of the coolant sub-boundary layer next to the airfoil surface, lower aerodynamic mixing loses due to low angle of cooling air injection, better film coverage in the span-wise direction and high film effectiveness for a longer distance downstream of the film hole. Since the film cooling hole break out shape is a radial ellipse on the airfoil surface, stress concentration is thus minimized.

DETAILED DESCRIPTION OF THE INVENTION

Figure 1:
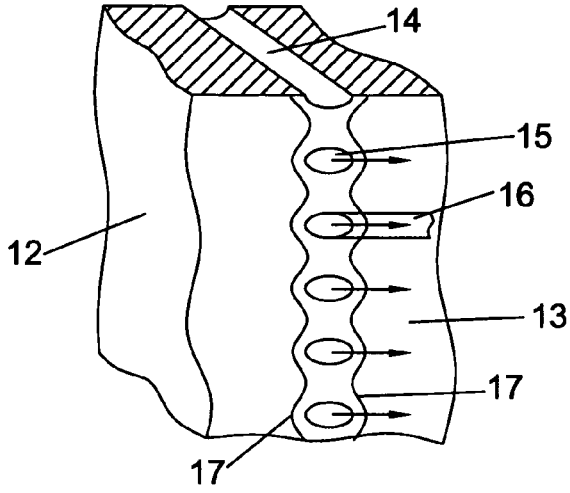
Fig 1 Prior Art
FIG. 1 shows a schematic view of an axial flow cooling hole of the prior art.
Figure 2A:
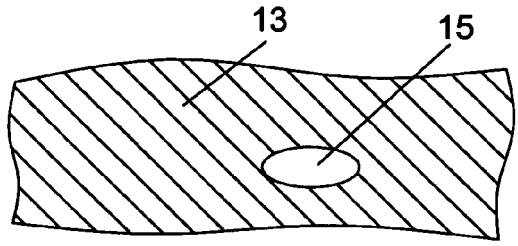
Fig 2a Prior Art
FIG. 2*a* shows a top view of the cooling hole of FIG. 1.
Figure 2B:
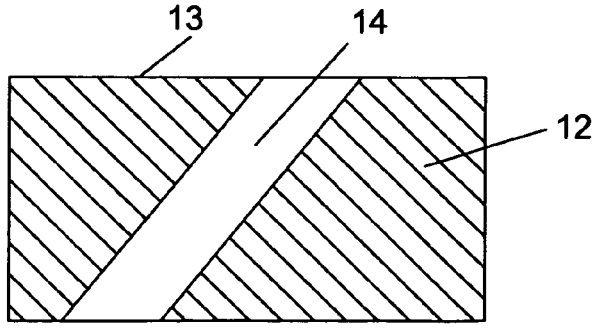
Fig 2b Prior Art
FIG. 2*b* shows a cross section view of the cooling hole of FIG. 1.
Figure 3:
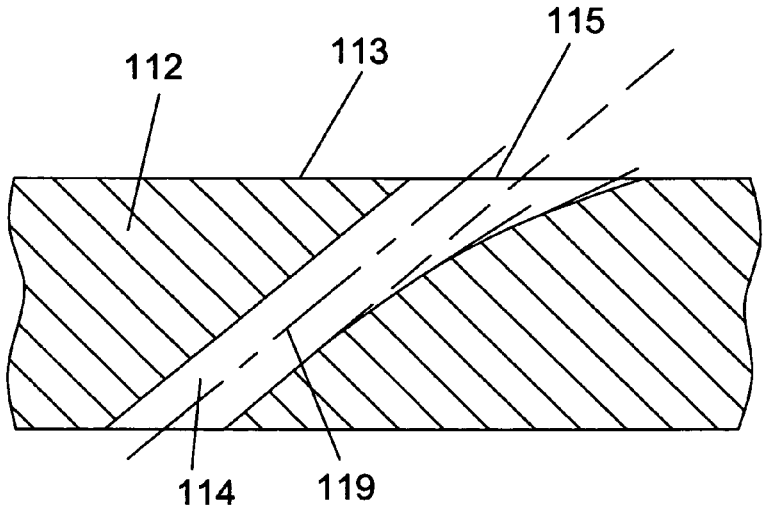
FIG. 3 shows a cross section view of the film cooling hole of the present invention.

The film cooling hole of the present invention is shown in FIG. 3 in the wall of the airfoil 112. The film cooling hole includes a straight cooling hole portion 114 and a diffusion portion with a hole opening 115 onto the airfoil surface 113. A straight centerline of the cooling hole is represented by the centerline in FIG. 3. The upstream side of the cooling hole forms a straight line path through the entire film cooling hole. The downstream side of the film cooling hole follows a continuous curvature in the direction of the hot gas flow. A continuous curvature with respect to the centerline 119 of about 7 degrees begins from the straight hole surface to the hole opening 115. The constant curvature of the diffuser sides can range from about 7 degrees to about 13 degrees while still providing for the benefits of the present invention.

Figure 4:
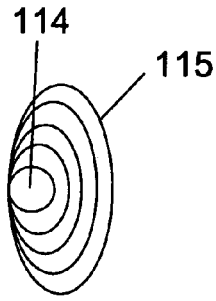
FIG. 4 shows a top view of a film cooling hole of the present invention.

The sides of the film cooling hole also follow a continuous curvature outward from the hole centerline as shown in FIG. 4. The top of the hole 115 in FIG. 4 represents the spanwise outward direction and the bottom of the hole in FIG. 4 represents the spanwise inward direction. The hot gas flow travels from left to right in FIG. 4. The right side of the hole 115 represents the stream-wise direction. The cross sections of the hole 115 shown in FIG. 4 follows an elliptical shape in which the left side of the hole follows a general straight line from entrance to exit of the hole. The hole 115 is formed from a series of ellipses that start from the end of the constant diameter hole 114 and progressively grow in cross-sectional shape until the hole 115 opens onto the airfoil surface 113. Again, the upstream side (left side in FIG. 4) of the ellipses is aligned to form a straight line and not a curved line like the remaining sides of the ellipses. The spanwise outward direction, the spanwise inward direction, and the stream-wise direction of the hole's curvature follows the outward curved shape shown in FIG. 3. The curvature of the stream-wise direction and both the spanwise outward and spanwise inward directions are a continuous curvature of about 7 degrees that form the diffuser. The 7 degree constant curvature angle is an ideal aerodynamic expansion number. However, the curvature can range from about 7 degrees to about 13 degrees while providing the benefits of the present invention. The cooling hole 115 opening onto the airfoil wall 113 is in the shape of an ellipse with a major to minor axis ratio in the range of 1.15 to 1.30 because of the constant curvature of the stream-wise and spanwise sides of the diffuser passage.

Figure 5:
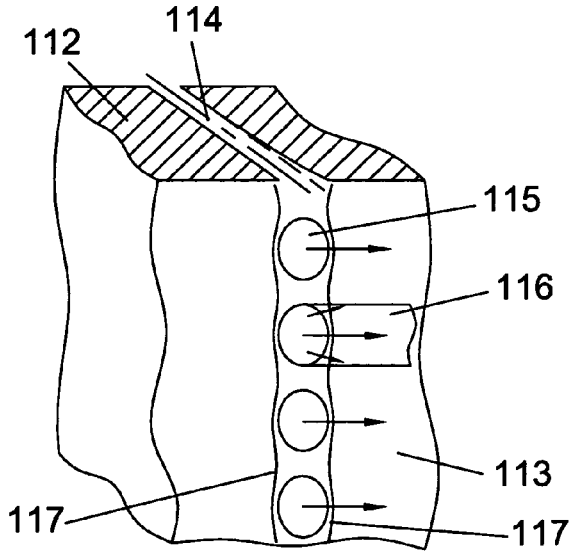
FIG. 5 shows a schematic view of the film cooling hole of the present invention.

With this cooling hole structure, the cooling air flowing into the diffuser section will expand in both the stream-wise direction and both inward and outward spanwise directions, providing for a wider film cooling effectiveness as represented by 116 in FIG. 5. Coolant penetration into the hot gas path is therefore minimized and better film coverage is obtained than that shown in the cited prior art references. The resulting cooling hole opening 115 is wider than the prior art, resulting in a wider film of cooling air passing over the airfoil wall from the hole, and yields a more uniform spanwise stress field as shown by 117 in FIG. 5.

I claim the following:

1. A turbine airfoil with an internal cooling circuit to provide internal conductive cooling for the airfoil and to provide cooling air through a plurality of film cooling holes located on an airfoil wall, the turbine airfoil comprising:

the film cooling holes each include a diffuser formed from a series of ellipses with a stream-wise downstream surface having a continuous curvature, a spanwise outward surface with a continuous curvature, and a spanwise inward surface with a continuous curvature such that an expansion occurs on three sides and not on an upstream side of the diffuser.

2. The turbine airfoil of claim 1, and further comprising:

the series of ellipses include a stream-wise upstream surface forming substantially a straight line.

3. The turbine airfoil of claim 2, and further comprising:

the film cooling holes each include an axial hole of substantially constant diameter to supply cooling air to the diffuser.

4. The turbine airfoil of claim 1, and further comprising:

the stream-wise downstream surface has a continuous curvature in a range of about 7 degrees to 13 degrees.

5. The turbine airfoil of claim 4, and further comprising:

the curvature of the spanwise outward surface and the spanwise inward surface of the diffuser has a continuous curvature in a range of about 7 to 13 degrees.

6. The turbine airfoil of claim 1, and further comprising:

the spanwise and stream-wise curvatures of the ellipses are such that the opening of the diffuser on the airfoil surface has an elliptical cross sectional shape with a major axis in the spanwise direction of the airfoil.

7. The film cooling hole of claim 6, and further comprising:

the cooling hole opening onto the airfoil wall has a major to minor axis ratio in the range of 1.15 to 1.30.

8. A film cooling hole for a turbine airfoil, the film cooling hole comprising:

a constant diameter hole in fluid communication with a cooling air supply channel;

a diffuser connected downstream from the constant diameter hole, the diffuser being formed from a plurality of elliptical cross sectional shaped surfaces each progressively increasing in cross sectional surface area in the downstream direction of the cooling air flow, and the stream-wise upstream surface of the plurality of elliptical cross sectional shaped surfaces being formed along a substantially straight line; and, the stream-wise direction of the ellipses having a continuous curvature in a range of about 7 to 13 degrees.

9. The film cooling hole of claim 8, and further comprising:

the constant diameter hole is a radial straight hole.

10. The film cooling hole of claim 8, and further comprising:

the constant diameter hole is a stream-wise straight hole.

11. The film cooling hole of claim 8, and further comprising:

the spanwise and stream-wise curvatures of the ellipses are such that the opening of the diffuser on the airfoil surface has an elliptical cross sectional shape with a major axis in the spanwise direction of the airfoil.

12. The film cooling hole of claim 11, and further comprising:

the cooling hole opening onto the airfoil wall has a major to minor axis ratio in the range of 1.15 to 1.30.

13. The film cooling hole of claim 8, and further comprising:

the curvature of the spanwise outward surface and the spanwise inward surface of the diffuser both have a continuous curvature in a range of about 7 to 13 degrees.

* * * * *